United States Patent [19]

Lemon et al.

[11] 4,180,994

[45] Jan. 1, 1980

[54] WASHING MACHINES

[75] Inventors: Maurice C. Lemon; John F. Spear, both of Dorking, England

[73] Assignee: Universal Towel Company Limited, Sussex, England

[21] Appl. No.: 932,315

[22] Filed: Aug. 9, 1978

[30] Foreign Application Priority Data

Aug. 12, 1977 [GB] United Kingdom ..... 33979/77

[51] Int. Cl.[2] ..... D06B 1/02; D06B 23/20

[52] U.S. Cl. ..... 68/18 F; 68/18 D; 68/47; 68/62; 68/205 R

[58] Field of Search ..... 68/205 R, 18 R, 18 F, 68/18 D, 62, 43, 44, 45, 47; 134/109, 111, 104, 60; 210/195 R, 305, 307, 320, 413, 414, 415, 521

[56] References Cited

U.S. PATENT DOCUMENTS

| | | | |
|---|---|---|---|
| 1,899,657 | 2/1933 | Zademach | 134/104 |
| 1,943,775 | 1/1934 | Taylor | 134/60 |
| 2,621,506 | 12/1952 | Hopkins et al. | 68/205 R X |
| 2,785,560 | 3/1957 | Ketchum et al. | 68/205 R |
| 3,279,225 | 10/1966 | Knudsen | 68/205 R X |
| 3,686,899 | 8/1972 | Rosenfeld et al. | 68/205 R X |

*Primary Examiner*—Philip R. Coe

*Attorney, Agent, or Firm*—Buell, Blenko & Ziesenheim

[57] ABSTRACT

A washing machine suitable for washing a washable dust mat comprises means for supplying a main wash liquid to each mat in turn from a tank, means for collecting at least the used main wash liquid and returning it to the tank, an overflow from the tank, means for employing the overflow of liquid from the tank in a pre-washing operation for each mat, and means for rinsing the washed mat. A single supply of water is thereby recirculated to provide the main wash liquid and also provides the pre-wash liquid.

5 Claims, 3 Drawing Figures

WASHING MACHINES

FIELD OF THE INVENTION

This invention relates to washing machines. More particularly but not exclusively, the invention relates to machines for washing dust mats made of cotton or nylon with a rubber, latex or nitrile backing.

PRIOR ART

In British Patent Specification No. 1493680 there is described a washing machine suitable for washing a washable dust mat which includes means for supplying a washing liquid to each mat in turn from a tank, and means for collecting the used washing liquid and returning the collected washing liquid to the tank whereupon it may be reused. Each mat is subsequently rinsed with a fresh supply of rinsing water, but the excess rinsing water is also collected and fed to the tank from which each cycle of washing liquid is supplied. Thus instead of using a fresh supply of washing liquid for washing each mat, the washing liquid used for one mat is collected in the tank together with the excess rinsing water and then the washing liquid for the next mat is withdrawn from the tank. The overall amount of water used and the amount of heat, e.g. steam, required compared with machines which use a fresh supply of water for each washing cycle, is considerably reduced. A proportion of the used washing liquid is continuously being drained from the tank, the amount of liquid being drained being equal to the amount of rinsing water being collected minus the amount of water retained by the mats.

It is well known to provide the washing machine with filtration apparatus so that heavily soiled mats may be washed without the used washing liquid in the tank becoming unacceptably dirty for further use, too quickly. Such filtration apparatus is described in the specification of British Patent Application No. 25692/76.

SUMMARY

According to the invention a washing machine suitable for washing a washable dust mat comprises means for supplying a main wash liquid to each mat in turn from a tank, means for collecting at least the used main wash liquid and returning it to the tank, an overflow from the tank, means for employing the overflow of liquid from the tank in a pre-washing operation for each mat, and means for rinsing the washed mat.

The pre-washing operation will remove a proportion of the dirt and particles from the mats and thereby help to stop the washing liquid in the tank from becoming unacceptably dirty, too quickly.

Preferably said means for employing liquid from the tank in a pre-washing operation comprises a second tank connected to said overflow from the first-mentioned tank, means for supplying the liquid from the second tank as a pre-wash liquid to each mat in turn, means for collecting the used pre-wash liquid and returning it to the second tank, and an overflow from the second tank connected to drain.

It is also preferred that each mat is rinsed with a fresh supply of rinsing water, the used rinsing water being collected in the first tank.

Preferably the washing machine includes arcuate guide means, e.g. a drum, around at least a part of whose circumference each mat is passed during its successive pre-wash, main wash and rinsing operations. In one embodiment of the invention at least one row of jets is provided for applying each of the main wash and pre-wash liquids, the pre-wash jets being upstream of the main wash jets, and both said jets being arranged to eject the respective liquid radially of the drum and at an angle to the vertical.

The means for collecting the used main wash liquid preferably include apparatus for filtering the liquid before it is returned to the respective tank. Also if means are provided for collecting the pre-wash liquid and returning it to a second tank, then such means preferably include filtration apparatus. The or each filtration apparatus preferably comprises means for screen filtering the respective liquid and also means for filtering the respective liquid by precipitation.

DESCRIPTION OF THE PREFERRED EMBODIMENT

This example is concerned with a machine for washing a succession of washable dust mats, which is similar to the washing machine shown in FIGS. 6 and 7 of British Patent Specification No. 1493680.

Figure 1:
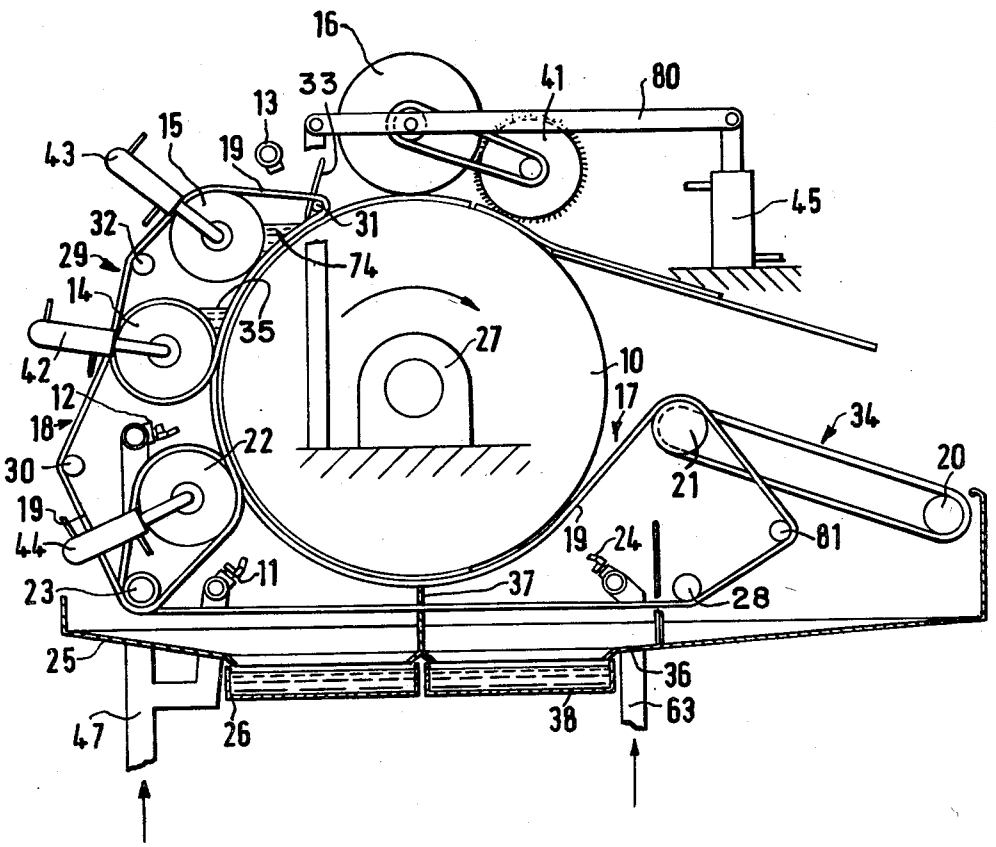
FIG. 1 is an elevation, by way of example, of the washing and rinsing sections of a washing machine for washable dust mats.

Referring to FIG. 1, the washing machine has a central, rotating drum 10 with two rows of main wash jets 11, 12, a supply pipe 13 for clean rinsing water, three squeeze rollers 14, 15 and 22, and a main pressure roller 16 disposed adjacent the peripheral surface of the drum 10. The drum is driven by a motor 27 in a clockwise direction as viewed in FIG. 1, and pneumatic jacks 42 to 44 are provided to cause the squeeze rollers 14, 15 and 22 respectively to effect a squeezing action on each mat 40. A further pneumatic jack 45 and linkage 80 is provided to actuate the pressure roller 16.

In the washing machine described in the aforesaid patent specification the equivalent wash jets are disposed at substantially the same level as the axis of the drum 10. However, in this embodiment, the main wash jets 11, 12 are at a lower position within the lower left-hand quartile as viewed in FIG. 1, and spaced apart on either side of the first squeeze roller 22 in the direction of movement of the mats. The jets 11, 12 are also arranged to eject the main wash liquid both radially of the drum and at a sufficient angle to the vertical to preclude the washing liquid falling back off the mats 40, which are substantially upside down at this point, onto the jets.

The mats 40 are carried around the drum by first, second and third carriers 17, 18, and 29 each of which comprises a series of cords or belts 19 spaced apart axially of the drum and driven either directly by the drum or by the mat passing between the drum and the respective belts. The belts of the first carrier 17 pass around the first squeeze roller 22 and four spindles 21, 23, 28 and 81 of which the spindle 81 has its ends mounted in slides for tensioning the belts after they have been joined.

In the case of the second carrier 18, the belts 19 pass around the spindle 23, the squeeze rollers 14 and 22 and a tensioning spindle 30. The belts of the third carrier 29 pass around the squeeze rollers 14, 15, a spindle 31 disposed intermediate the third squeeze roller 15 and the pressure roller 16, and a tensioning spindle 32. The spindle 31 is freely mounted within a wedge-like space created between the surface of the drum 10 and a plate 33 disposed at an angle of about 15° to the vertical, the spindle being kept in the space by the tension of the belts of the third carrier. If desired, the belts of the second and third carriers 18, 29 may be passed around a common tensioning roller.

The spaced apart belts 19 of the first and second carriers 17, 18 allow the main wash liquid to be applied to the mat being washed between the belts. Also, the belts of the two carriers are not aligned in the direction of movement of the mats so that no portion of the mat is hidden from both rows of main wash jets 11, 12.

Upstream of the main wash jets 11, 12 and disposed in the lower, right-hand quartile of the drum as viewed in FIG. 1, is a row of pre-wash jets 24 which like each row of the main wash jets 11, 12 are directed radially at the drum at a sufficient angle to the vertical to avoid the pre-wash liquid falling back off the mat 40 being washed on to the jets 24.

To feed each mat in turn to the first carrier 17 there is provided a further belt conveyor 34 whose belts pass around a spindle 20 and the above-mentioned spindle 21 of the first carrier, the belts of the conveyor 34 passing around a smaller radius on the spindle 21 than the belts 19 of the first carrier so that they travel at a slower speed than the belts 19 of the first carrier.

Also, in this embodiment, downstream of the pressure roller 16, there is a brush roller 41, which is driven in an anticlockwise direction as viewed in FIG. 1 by drive means from the pressure roller 16 at a faster speed than the pressure roller, to fluff up the pile of the mats after they have been washed and rinsed and to act as a stripper should the mats tend to cling to the pressure roller 16. The roller 41 is mounted so that its position is adjustable radially of the drum. In other embodiments, instead of or in addition to the brush roller 41 there is provided an impregnating roller for applying a finishing oil to the mats.

It will be appreciated that in operation of the apparatus described so far, each mat to be washed is successively pre-washed by a pre-wash liquid applied to the mat by the pre-wash jets 24, washed by a main wash liquid applied by the main wash jets 11, 12, and rinsed by water from the pipe 13. The first and second squeeze rollers 22, 14 act to remove a proportion of the main wash liquid from the mat. The rinsing operation takes place in two stages, the cleaner water from the pool 74 of the second rinsing stage passing through grooves in the third squeeze roller 15 provided for the belts of the third carrier 29 to form the pool 35 of the first rinsing stage. The used main wash liquid and the used rinsing water removed from the mats by all three squeeze rollers 14, 15 and 22 and the pressure roller 16 is collected by a funnel 25 and directed into a first catchment tray 26 extending longitudinally of the roller 10. Similarly, the used pre-wash liquid is collected by a funnel 36 which is separated from the funnel 25 by a screen 37 and directed into a second catchment tray 38.

Figure 2:
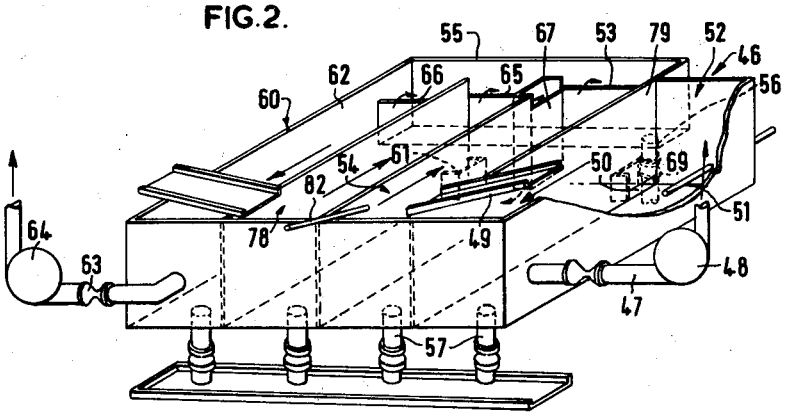
FIG. 2 is a perspective view of the water recycling tanks of the washing machine of FIG. 1.
Figure 3:
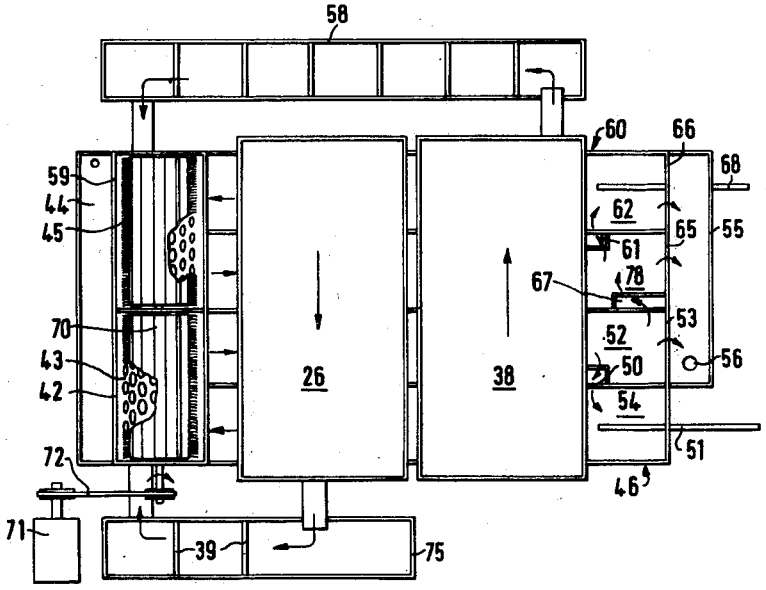
FIG. 3 is a plan view of the recycling tanks and the filtration apparatus of the washing machine of FIG. 1.

The apparatus provided for recycling the major proportion of the collected liquid for supplying the main wash jets 11, 12 and the pre-wash jets 24 will now be described. With reference to FIGS. 2 and 3, liquid collected by the first catchment tray 26 passes into a channel 75 provided with transverse baffles 39 which assist the precipitation of dirt and particles from the liquid. The liquid then passes into a screen filtration channel 42 having a curved perforated base 43 to separate out loose fibres and other floating matter from the liquid which are swept from the channel into a receptacle 44 by a rotary double-ended brush 45 mounted on a spindle 70 which is driven by a motor 71, through a drive belt 72. The filtered liquid passes through the base 43 of the channel 42 onto a chute 49 leading to a tank 46 which is the supply tank for the main wash liquid and which is connected to both rows of main wash jets 11, 12 by pipework 47 including a pump 48. A feed pipe 82 is provided for dispensing detergent into the tank 46 at an appropriate rate. Also to extend the path of the liquid within the tank in order that even more dirt and particles will precipitate out, the tank has a longitudinal dividing wall 79 with a communicating aperture 50. The liquid is reheated by steam from a pipe 51 located in the downstream part 52 of the tank 46. An overflow 53 is provided at the end of the upstream part 54 of the tank which is remote from the chute 49 for the removal of floating effluent and suds. The overflow 53 leads to a receptacle 55 having an outlet 56 to drain. The base of each part 52, 54 of the tank 46 also has an outlet 57 to drain which is normally closed but which may be opened to allow the tank to be cleaned.

The used pre-wash liquid collected by the second catchment tray 38 is also passed through a precipitation channel 58 and a screen filtration channel 59 before entering the upstream part 78 of a second tank 60. The part 78 has a communication aperture 61 with the downstream part 62 of the tank 60 which is connected to the pre-wash jets 24 by pipework 63 including a pump 64. In the case of this second tank 60, the upstream part 38 has an overflow 65 for the suds and other floating matter and the downstream part has a lower overflow 66 for excess liquid, both overflows passing into the same receptacle 55 as the overflow 53 of the tank 46. At the same time there is provided an overflow connection 67 between the upstream parts 52, 78 of the two tanks 46, 60 whereby there is a constant feed of liquid from the tank 46 into the tank 60. The liquid in the second tank 60 is reheated by steam from a pipe 68.

In practice it is intended that the amount of liquid passing out of the second tank 60 by the overflow 66 should equal the amount of rinsing water used less the amount of water retained by the mats. The drain outlet 56 of the overflow receptacle 55 although normally open is provided with a valve 69 to allow the outlet 56 to be closed should the washing machine have to be stopped. Closure of the valve 69 may be used to maintain the tanks 46, 60 at a priming level and thereby avoid both the wastage of liquid to drain and the necessity to refill the tanks to the required levels before the washing machine can be restarted.

It will thus be appreciated that in the embodiment described above a proportion of the main wash liquid and rinsing water, which would otherwise be passed to drain, is used to perform a pre-wash operation on the mats. This pre-wash operation serves to remove some of the dirt and particles in each mat before the main washing operation thereon. More importantly, it reduces the amount of dirt and particles which would otherwise be removed during the main wash operation and thus results in the liquid in the tank 46 remaining sufficiently clean for recirculation to the main wash jets 11, 12 over a longer washing period than would otherwise be the case.

We claim:

1. A washing machine for washing a washable dust mat comprising a drum around at least a part of whose circumference each mat is passed during successive pre-wash, main wash and rinsing operations, a first tank means for supplying a main wash liquid to each mat in turn from the first tank, means for collecting the used main wash liquid and returning it to the first tank, an overflow from the first tank, a second tank connected to said overflow from the first tank, means for supplying the liquid from the second tank as a pre-wash liquid to each mat in turn, means for collecting the used pre-wash liquid and returning it to the second tank, an overflow from the second tank connected to drain, a supply of fresh water for rinsing each mat, and means for collecting the used rinsing water and feeding it to the first tank.

2. A washing machine as claimed in claim 1, wherein at least one row of jets is provided for applying each of the main wash and pre-wash liquids, the pre-wash jets being upstream of the main wash jets, and both said jets being arranged to eject the respective liquid radially of the drum and at an angle to the vertical.

3. A washing machine as claimed in claim 1, wherein the means for collecting the used main wash liquid include apparatus for filtering the liquid before it is returned to the first tank.

4. A washing machine as claimed in claim 1, wherein the means for collecting the used pre-wash liquid include apparatus for filtering the liquid before it is returned to the second tank.

5. A washing machine as claimed in claim 3 or claim 4, wherein the or each filtration apparatus comprises means for screen filtering the respective liquid and also means for filtering the respective liquid by precipitation.

* * * * *